United States Patent [19]

Hanstein et al.

[11] Patent Number: 4,490,948

[45] Date of Patent: Jan. 1, 1985

[54] POLISHING PLATE AND METHOD FOR POLISHING SURFACES

[75] Inventors: Friedrich Hanstein, Gross-Zimmern; Peter R. Szigeti, Buettelborn, both of Fed. Rep. of Germany

[73] Assignee: Röhm GmbH, Darmstadt, Fed. Rep. of Germany

[21] Appl. No.: 395,096

[22] Filed: Jul. 6, 1982

[30] Foreign Application Priority Data

Aug. 13, 1981 [DE] Fed. Rep. of Germany ..... 3132028

[51] Int. Cl.[3] ..... B24B 37/00

[52] U.S. Cl. ..... 51/358; 51/263; 51/267; 51/292

[58] Field of Search ..... 51/209 R, 209 DL, 266, 51/267, 292, 317, 358, 376, 400, 401, 402, 404, 405, 406, 407, 263, 391, 392, 393; 401/196, 200, 203, 204, 205

[56] References Cited

U.S. PATENT DOCUMENTS

| | | | |
|---|---|---|---|
| 2,496,033 | 1/1950 | Berry | 401/203 X |
| 2,567,782 | 9/1951 | Rhees | 51/376 |
| 2,644,280 | 7/1953 | O'Neil | 51/406 |
| 3,107,456 | 10/1963 | Wallers et al. | 51/263 X |
| 3,345,281 | 10/1967 | Falls | 51/267 X |
| 3,754,359 | 8/1973 | Scandaletos | 51/266 X |
| 3,820,904 | 6/1974 | Lindfren | 401/196 X |
| 3,875,703 | 4/1975 | Clemente | 51/406 X |
| 4,102,084 | 7/1978 | Bloomquist | 51/267 X |

FOREIGN PATENT DOCUMENTS

| | | | |
|---|---|---|---|
| 2003770 | 3/1979 | United Kingdom | 51/376 |

*Primary Examiner*—Robert P. Olszewski

*Attorney, Agent, or Firm*—Curtis, Morris & Safford

[57] ABSTRACT

A polishing plate for polishing the surface of synthetic resins has a rigid disk and a compressible cover abutting a lower surface of the rigid disk. The rigid disk has an inlet opening formed centrally therein and a plurality of channels formed in the lower surface thereof. The cover has a plurality of layers including an upper layer of soft foam adjacent the lower surface of the rigid disk, a lower layer having a textile surface structure and which contacts a surface to be polished, and a middle layer which is permeable to liquid and interposed between the upper and lower layers. A method of polishing a surface has as its first step supplying a polishing agent to a central opening formed in a rigid disk. The polishing agent is then uniformly distributed to an upper portion of a cover which is adjacent a lower surface of the disk through a plurality of channels formed in the lower surface of the disk, the channels communicating with the central opening to allow the polishing agent to flow therethrough. Next, the polishing agent is supplied to a lower portion of the cover through a plurality of access openings formed in the cover and disposed below the channels. The polishing agent is then uniformly applied to the surface to be polished by permeation of the polishing agent through the lower portion of the cover.

10 Claims, 2 Drawing Figures

POLISHING PLATE AND METHOD FOR POLISHING SURFACES

BACKGROUND OF THE INVENTION

Field of the Invention

The present invention relates to a polishing plate adaptable to polishing the surface of synthetic resins and to methods for polishing synthetic resin surfaces. More in particular, the invention relates to a polishing plate in which a polishing agent is conducted outwardly from the center of a polishing plate and to methods of polishing employing such a device.

The demands made on the quality of synthetic resin surfaces, particularly when sheets of synthetic resin are to be used for glazing, for instance in the construction of aircraft, are extraordinarily high.

The classic method for finishing synthetic resin surfaces is by grinding and polishing. Because of the temperature sensitivity of the synthetic resin, grinding is as a rule carried out with ample water cooling. The grinding pressure is kept low in order to avoid a clogging or seizing of the grinding wheel. Polishing is preferably carried out using a circular movement and a disc of felt, plain cortan fabric in a tabby weave, or molleton, which revolves at a speed of about 25 to 30 meters per second.

In principle, grinding and polishing apparatus known from metal working can be employed. Polishing machines in which an aqueous solution of a polishing agent is led from the center of a rotating polishing plate are part of the state of this art.

The agents and apparatus of the prior art can not fully satisfy the exacting requirements invalued in polishing synthetic resin surfaces, particularly the demands made on transparent synthetic resins for glazing, especially in aircraft construction. The surfaces which are polished by machine after prior grinding are, on the average, by no means perfect. Thus, it has often been necessary to remove surface defects, for example numerous grinding scratches, by hand polishing. Thus, there was presented the problem of developing a grinding apparatus which, by the lowest possible expenditure for apparatus and construction, would successfully accomplish the polishing of synthetic resin surfaces of the quality desired.

SUMMARY OF THE INVENTION

It has now been found that this result can be accomplished by the use of an improved polishing plate comprising a rigid disk having thereover a cover, compressible to a certain degree, comprising a soft foam layer adjacent the disk, a further abutting layer also made of a material permeable to liquid, and a sealing cover layer, wherein the rigid disk has a plurality of radially outwardly directed channels open to the bottom for an (aqueous) polishing agent.

BRIEF DESCRIPTION OF THE DRAWINGS

A better understanding of the present invention and of its many advantages will be had by referring to the accompanying drawings, in which.

DESCRIPTION OF THE PREFERRED EMBODIMENT

Figure 1:
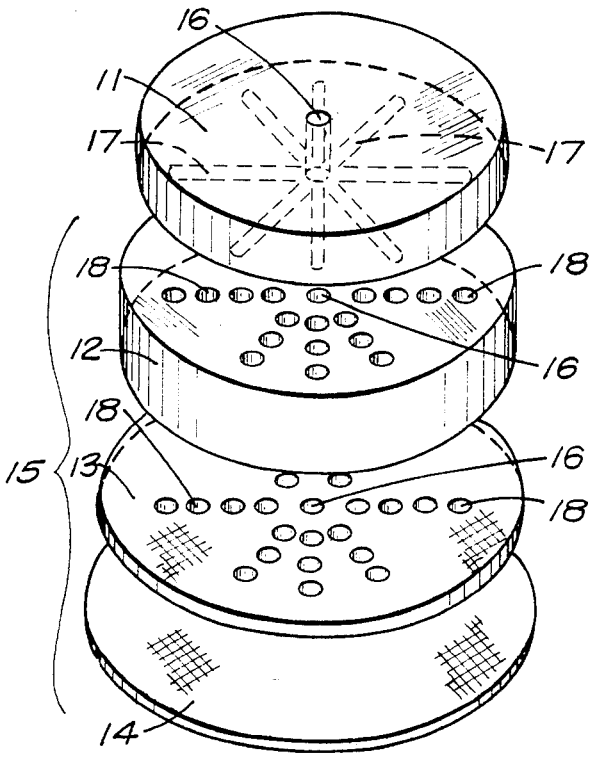
FIG. 1 is an exploded view of a polishing plate according to the invention.
Figure 2:
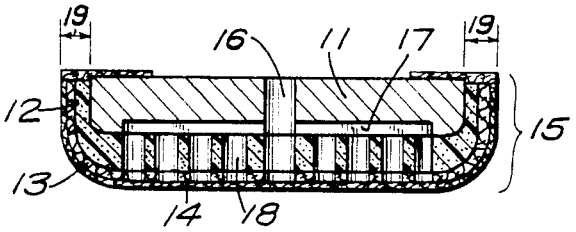
FIG. 2 is a side view in section of the assembled plate.

Referring to the drawings, rigid disk 11 is patterned after the grinding disks of the state of the art. It can be fashioned, for example, from water-resistant wood, from aluminum, or possibly also from synthetic resin, or in a "sandwich" construction. It is provided in its center with inlet opening 16 which is, in practice, a hole having a diameter of about 60 mm (as a guide value), and further has in one face thereof a plurality of channels 17. The diameter of disk 11 is variable within certain limits according to the use for which it is intended. For example, it can be of a size between about 100 mm up to about 1200 mm.

The thickness of disk 11 is such that it is accommodated to the mechanical demands made on it during the polishing operation (the presence of channels 17 is to be taken into account). In general, the thickness of disk 11 should not exceed a value of about 40 mm.

Disc 11 is sheathed by cover 15 comprising a plurality of layers.

Layer 12 which directly abuts on rigid disk 11 preferably comprises a high-quality soft synthetic resin foam, preferably an open-pored soft foam (cf. Ullmann's Encyclopaedie der Technischen Chemie, 4th Edition, Vol. 19, pages 318–324, Verlag Chemie, 1980). As a model for such a high-quality synthetic resin foam can be understood to be one having a residual pressure deformation (percent), measured according to DIN 53 572, of 8 or less at 50 percent compression. Further, the decrease of the indentation pressure in the bending fatigue test according to DIN 53 574 can be used as a criterion.

The average pore size of the soft foam in layer 12 is not really critical. As a rule, it is between 0.5 and 1.5 mm, particularly at 0.6 mm.

As materials particularly suitable for the synthetic resin foam, polyurethane foam (polyether foam) and polyimide foam should be mentioned, for example. The thickness of layer 12 is as a rule between 10 and 30 mm, preferably 20 mm.

Layer 13 abutting layer 12 preferably comprises a voluminous non-woven textile. For example, stitched nonwoven fabric, strengthened wadding and, particularly, felt, have proved particularly suitable. In general, the thickness of layer 13 is from 5 to 10 mm, preferably about 8 mm.

Cover layer 14 primarily serves as a coating. It forms a barrier layer for the apparatus and, in use, stands in contact with the synthetic resin surface to be polished.

Layer 14 thus suitably comprises a wear-resistant textile surface structure that in itself effects no grinding, or only a very slight grinding.

For example, textile knitted goods of sufficient fineness, particularly the so-called "glove materials" have proved suitable.

Cover layer 14 will as a rule comprise one or more layers of a textile having the aforementioned properties, i.e. its thickness is in general in the region between 100 and 500 microns. Normally, layers 12 and 13 and the cover layer 14, which form cover 15, which latter is compressible to a certain degree, are so arranged that cover 15 together with rigid disk 11 forms a compact unity. Suitably the diameters of layers 12 and 13 and of cover layer 14 are successively larger than that of rigid disk 11, so that the layers extend over the edge of rigid disk 11 to form a bead. Cover layer 14 suitably extends continuously to the back side of rigid disk 11. The same can also be true for layers 13 or 12. In practice, cover layer 14 holds layers 12 and 13 and rigid disk 11 together as a compact unit.

Preferably, inlet openings 18 are provided in layer 12, which openings are continued in layer 13 in the region beneath channels 17, for example in the form of holes. As concerns the form and the number of inlet openings 18, one can rely on the experience of those skilled in the art. In general, inlet openings 18 have the form of round holes with a diameter from 5 to 20 mm, preferably 10 to 15 mm. The number of holes beneath a particular individual channel 17 is between 3 and 10, preferably 5 or 6.

The number of holes 18 corresponds within certain limits conversely to the size of the holes. For example, as a model, one can reckon with a disk 11 having a diameter of 1200 mm and a total of 6 channels 17 each with 5 inlet openings (holes) 18 having a diameter of about 10 mm.

The number of channels 17 is influenced within certain range by the size of disk 11. With an increasing size of the disk, the number of channels 17 also increases. About 5 channels can be taken as a lower limit and about 10 channels can be taken as an upper limit. Six channels are preferred. Channels 17 suitably have a depth of about 4 mm, but different depths are also possible.

Channels 17 suitably have a tapered shape, i.e. their diameter decreases outwardly from central opening 16 to the edge of disk 11. In the edge region of disk 11, the diameter of the channels is zero.

The diameter of channels 17 at that site where they enter into inlet opening 16 is dependent on the number of channels. In one advantageous embodiment, channels 17 are directly adjacent and are contiguous in the region of the inlet opening 16. In this case, the channels in the region of the inlet opening as a rule have a diameter of from 5 to 20 mm.

The polishing plates according to the present invention are suitable for use as the polishing element in already known commercially available polishing machines and, also, known appropriate aqueous polishing agents can be used.

The apparatus according to the present invention fulfills the aforementioned demands of technology in an outstanding fashion. During the course of the polishing process, only slight, exactly dosable amounts of polishing agent are applied to the surface to be polished, whereby a uniform application of polishing agent per unit of surface area of the synthetic resin surface to be polished is preferred. In the same way, the polishing plate according to the present invention assures that water is introduced in a sufficient amount onto the surface being polished so that a sufficient cooling of the surface is guaranteed. The definitely improved surface quality achieved, combined with a simultaneous large reduction in working time, is of decisive significance when the present invention is compared with the polishing method of the state of the art. The working time, for example, is only a fraction of the working time heretofore found necessary.

The use of the polishing plate according to the present invention simultaneously with aqueous polishing agents, particularly those of the type involving a slurry of one or more metal oxides in an aqueous carrier medium, is particularly preferred.

The new polishing plates are suitable in a Cardan mounting for the treatment of non-planar, for example spherical and cylindrical, surfaces.

What is claimed is:

1. A polishing plate for polishing with liquid polishing agents containing polishing powder comprising: a rigid disk having a central polishing agent inlet opening formed therein and a lower surface having a plurality of channels formed therein communicating at one end with said inlet opening and extending radially outwardly from said inlet opening to distribute the liquid polishing agent along said lower surface; and a compressible cover abutting the lower surface of said rigid disk and having a plurality of layers including an upper layer of soft foam adjacent the lower surface of said rigid disk, an unperforated lower layer having a textile surface structure and which contacts a surface to be polished, and a middle layer, permeable to liquid, interposed between said upper and lower layers, said compressible cover being formed so that the polishing agent can pass therethrough to the textile surface which contacts the surface to be polished.

2. A polishing plate as defined in claim 1 wherein said upper layer has formed therein a plurality of access openings disposed below and in communication with said channels of said rigid plate.

3. A polishing plate as defined in claim 2 wherein said middle layer has formed therein a plurality of access openings disposed below and in communication with said access openings of said upper layer.

4. A polishing plate as defined in claim 1 wherein said channels of said rigid disk have diameters which decrease in a radially outward direction from said central opening.

5. A polishing plate as defined in claim 4 wherein said channels have approximately zero diameter at an edge portion of said disk and wherein adjacent channels converge to interconnect at a central portion of said disk.

6. A polishing plate as defined in claim 1 wherein the diameters of said upper, middle and lower layers are successively increasing and greater than that of said rigid disk and wherein said upper, middle and lower layers extend over an edge of said rigid disk to form a bead.

7. A polishing plate as defined in claim 6 wherein at least one of said layers extends to an upper surface of said rigid disk.

8. A polishing plate as defined in claim 1 wherein said upper layer comprises a soft synthetic resin foam.

9. A polishing plate as defined in claim 1 wherein said middle layer comprises a voluminous non-woven textile material.

10. A polishing plate as defined in claim 1 wherein said lower layer comprises a finely woven textile material.

* * * * *